US006373180B1

(12) United States Patent
Azzi et al.

(10) Patent No.: US 6,373,180 B1
(45) Date of Patent: Apr. 16, 2002

(54) DEFLECTION YOKE FOR A CATHODE-RAY TUBE WITH BOTH IMPROVED GEOMETRY AND CONVERGENCE

(75) Inventors: Nacerdine Azzi, Fontaine-les-Dijon; Olivier Masson, Cuisery, both of (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/446,033

(22) PCT Filed: Jul. 24, 1998

(86) PCT No.: PCT/EP98/04969

§ 371 Date: Dec. 15, 1999

§ 102(e) Date: Dec. 15, 1999

(87) PCT Pub. No.: WO99/05693

PCT Pub. Date: Feb. 4, 1999

(30) Foreign Application Priority Data

Jul. 28, 1997 (FR) ..... 97 09535

(51) Int. Cl.[7] ..... H01J 29/76

(52) U.S. Cl. ..... 313/440; 335/213; 335/210; 348/831

(58) Field of Search ..... 313/440, 426; 335/213, 210, 299; 348/831

(56) References Cited

U.S. PATENT DOCUMENTS

| | | | | | |
|---|---|---|---|---|---|
| 3,913,042 | A | | 10/1975 | Talsma | 335/210 |
| 5,952,905 | A | * | 9/1999 | Kim et al. | 313/440 X |
| 5,977,700 | A | * | 11/1999 | Lee | 313/440 |
| 6,016,093 | A | * | 1/2000 | Grubben et al. | 313/440 X |

FOREIGN PATENT DOCUMENTS

| | | | | |
|---|---|---|---|---|
| EP | 0701267 | | 3/1996 | H01J/29/76 |
| FR | 2220870 | | 10/1974 | H01J/29/76 |
| GB | 2306767 | | 5/1997 | H01J/29/76 |
| JP | 61-168843 | | 7/1986 | H01J/29/76 |
| JP | 3-145039 | * | 6/1991 | 313/440 |

* cited by examiner

*Primary Examiner*—Ashok Patel
(74) *Attorney, Agent, or Firm*—Joseph S. Tripoli; Harvey D. Fried; Sammy S. Henig

(57) ABSTRACT

A deflection yoke mounted on a neck of a cathode ray tube includes a pair of horizontal deflection coils, a pair of vertical deflection coils and a core of a ferromagnetic material. The core has magnetic reluctance, in a front region, close to a screen end of the tube, that is greater along the vertical direction than along the horizontal direction. In one embodiment of the invention this feature is achieved by making recesses at the intersection of a flared front part of the core with the horizontal plane of symmetry XZ. In another embodiment of the invention, the thickness of the core varies.

6 Claims, 3 Drawing Sheets

DEFLECTION YOKE FOR A CATHODE-RAY TUBE WITH BOTH IMPROVED GEOMETRY AND CONVERGENCE

The invention relates to a deflection yoke for a colour cathode-ray tube.

A deflection yoke includes a pair of vertical deflection coils, a pair of horizontal deflection coils in the form of a saddle and a ring of ferromagnetic material surrounding the deflection coils so as to concentrate the deflection fields in the appropriate region. A cathode-ray tube intended to generate colour images generally includes an electron gun emitting three coplanar electron beams, each beam being intended to excite a phosphor of a defined primary colour (red, green or blue) on the screen of the tube.

The electron beams scan the screen of the tube under the influence of the deflection fields created by the horizontal and vertical deflection coils of the deflection yoke fixed to the neck of the tube.

The three beams generated by the electron gun must always converge on the screen of the tube, otherwise a so-called convergence error is introduced which falsifies, in particular, the rendition of the colours. In order to make the three coplanar beams converge, it is known to use so-called self-converging astigmatic deflection fields; in a self-converging deflection coil, the intensity of the field or the lines of flux which are caused by the horizontal deflection winding are generally in the form of a pin-cushion in the region of a portion of the coil which is located somewhat to the front of the latter on the side facing the screen of the tube.

Moreover, under the action of uniform horizontal and vertical deflection fields, the volume scanned by the electron beams is a pyramid whose apex is coincident with the centre of deflection of the deflection yoke and whose intersection with a non-spherical screen surface exhibits a geometrical defect called pin-cushion distortion. This geometrical distortion of the image increases as the radius of curvature of the screen of the tube increases.

Self-converging deflection yokes generate astigmatic deflection fields which make it possible to modify the North/South and East/West geometry of the image and, in particular, partially correct for the North/South pin-cushion distortion.

The correction of both the convergence of the electron beams and the North/South geometry of the image on the screen, by means of a particular configuration of the conductors making up the deflection coils, has been difficult to achieve without additional components, such as metal pieces or permanent magnets. The additional components are placed so as to cause local modification of the deflection fields. These additional components may be expensive and may lead to overheating problems associated with the operating frequency, particularly when they are used to modify the horizontal deflection field, since the current trend is towards increasing the said frequency up to 32 kHz or even 64 kHz.

Moreover, these image-geometry and convergence problems are associated with the planarity of the screen and increase with the radius of curvature of the said screen. Conventional cathode-ray tubes manufactured a few years ago, using a screen of spherical shape, generally have a radius of curvature R. When the screen has a relatively large radius of curvature, greater than 1R, such as 1.5R or more for example, it becomes increasingly difficult to fix the problems mentioned above merely by means of suitable fields generated by the deflection coils.

Published European Patent Application EP 701,267 discloses a means of controlling the North/South geometry of the image created by the deflection yoke on the screen surface, as well as the convergence of the beams, using a ring or core of ferromagnetic material to concentrate the deflection fields. Part of the core, closest to the screen of the tube, is arranged in such a way that the regions closest to the vertical axis of symmetry have a magnetic reluctance greater than the regions closest to the horizontal axis of symmetry. However, this arrangement may require the use of an additional field shaper for local correction of the defects.

It may be desirable to employ in a deflection yoke for a colour cathode-ray tube a magnetic core having a geometry of which makes it possible to correct both convergence and geometrical errors without using additional field shapers.

In accordance with an inventive feature, a deflection yoke includes a pair of horizontal deflection coils and a pair of vertical deflection coils. An approximately frustoconical ferromagnetic core is placed, at least partly, over the deflection coils. The core has a vertical plane of symmetry, YZ, and a horizontal plane of symmetry, XZ. The magnetic reluctance of the core, in its front part, in the vicinity of the horizontal plane of symmetry, is greater than in the vicinity of the vertical plane of symmetry.

IN THE DRAWINGS

Figure 1:
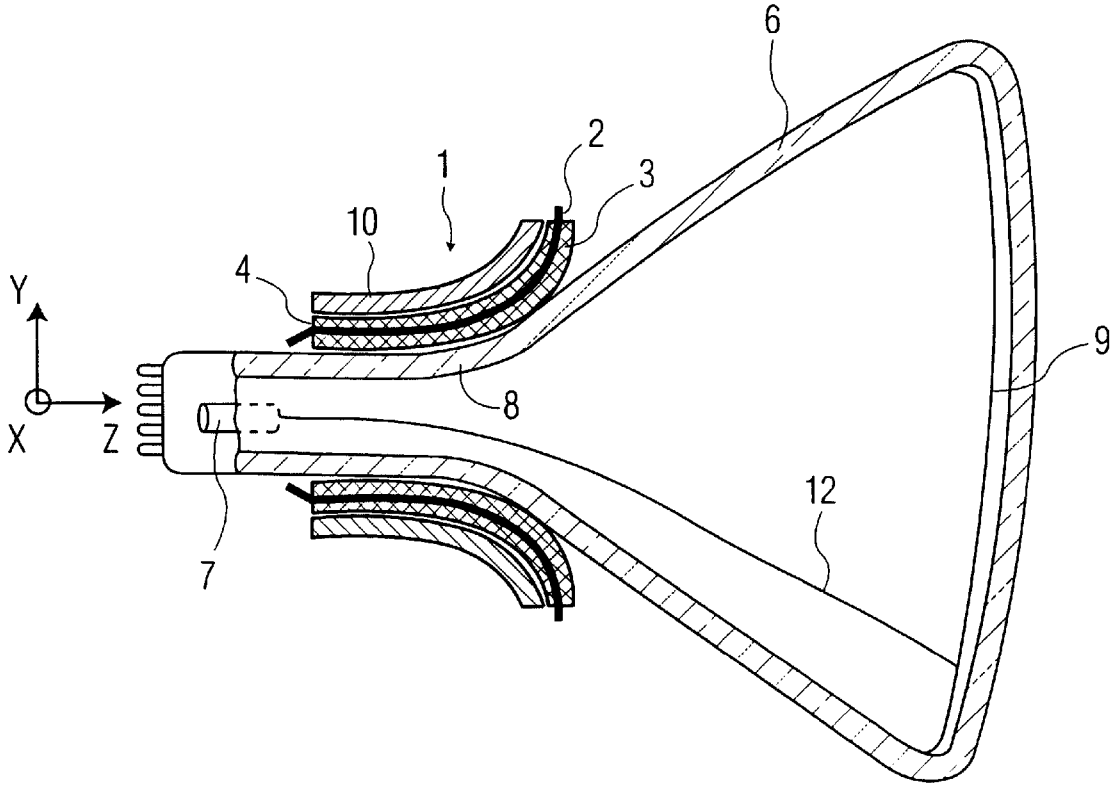
FIG. 1 shows a cathode-ray tube equipped with a prior art deflection yoke for deflecting the electron beams.

As illustrated in FIG. 1, a self-converging colour display device comprises a cathode-ray tube (CRT) 50 provided with an evacuated glass envelope 6 and an array of phosphor elements representing three colours arranged at one of the ends of the envelope forming a display screen 9. A set of three in-line of electron guns 7 is arranged at a second end of the envelope. The set of electron guns is arranged so as to produce three electron beams 12 which are aligned horizontally so as to excite the corresponding various colour phosphor elements. The electron beams scan the entire surface of the screen by means of a deflection yoke 1, placed on a neck 8 of CRT 50. Yoke 1 includes a pair of horizontal deflection coils 3, a pair of vertical deflection coils 4, separated from each other by a separator 2 and a ferromagnetic core 10 intended to concentrate the field where it is intended to act.

A conventional deflection yoke for a CRT, of the self-converging type, causes the electron beams to converge onto a screen panel of the CRT by virtue of a non-uniform magnetic deflection fields. In the deflection yoke, the horizontal deflection field has a pin-cushion-shaped intensity distribution and the vertical deflection field has a barrel-shaped intensity distribution. The intensity distribution of the horizontal field provides a partial correction of the North/South geometrical distortion of the image. However, this non-uniform field may cause a so-called gull-wing distortion of the horizontal edges of the image on the screen. This distortion is due to the fifth-order and higher-order harmonic components of the series decomposition of the deflection field.

Figure 2:
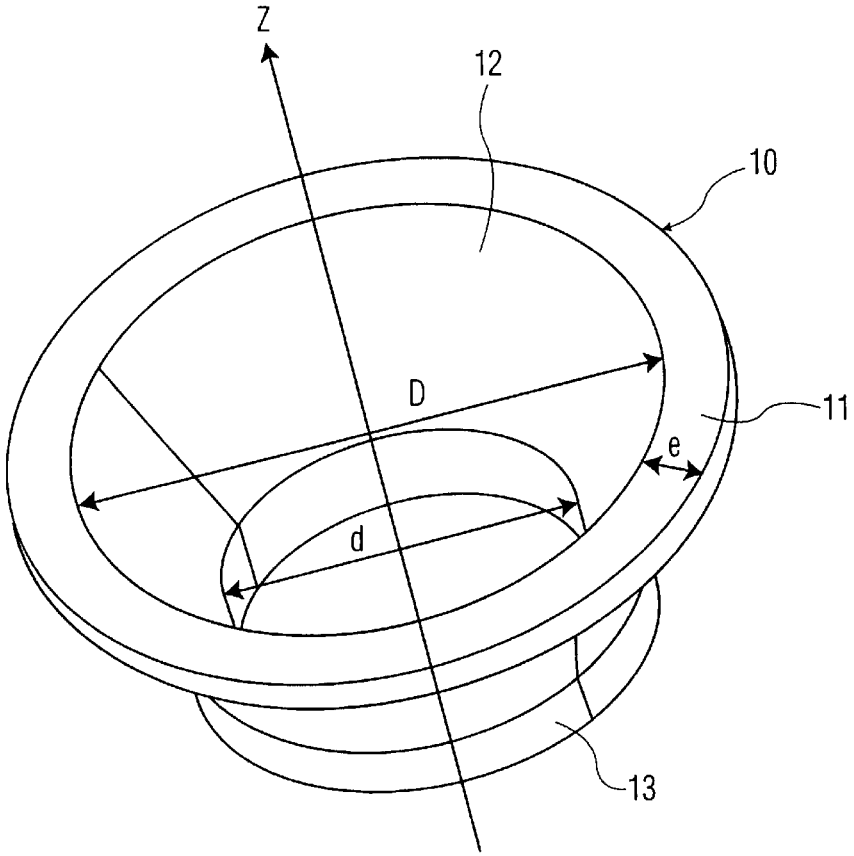
FIG. 2 shows a ring or core made of ferromagnetic material according to the prior art.

A deflection yoke according to the prior art incorporates a core or ring of ferromagnetic material, as illustrated in FIG. 2. This ring is generally symmetric with respect to an axis Z and has a rear part 13 of internal diameter d. It has a flared part 12 which terminates in a front surface 11 contained in a plane perpendicular to axis Z. The internal diameter of the front part is D. The thickness "e" of the ring, measured in a section perpendicular to its surface, is approximately constant.

Figure 3:
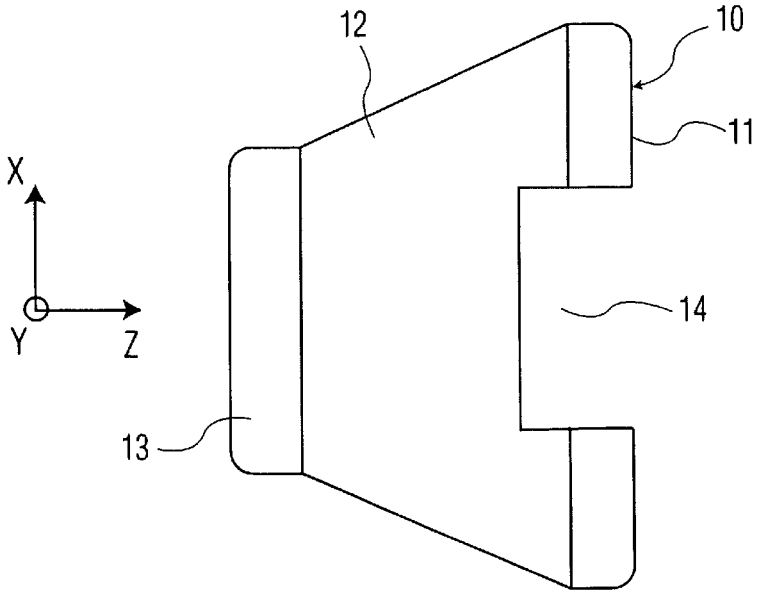
FIG. 3 shows another embodiment of a ferromagnetic ring according to the prior art.

According to one prior art, illustrated in FIG. 3, the ring or core may have in its front part recesses 14 which are arranged symmetrically with respect to the XZ plane and lie in the vicinity of the intersection with the YZ plane. These recesses locally alter the magnetic reluctance of the ring and alter the distribution of the lines of force of the deflection fields. This arrangement may improve the North/South geometry of the image as well as minimize the gull-wing distortions. It also may improve the situation with regard to the convergence of the electron beams along the X and Y axes of the screen. However, the convergence situation in intermediate positions may be highly degraded, in particular in the corners of the image.

Figure 4:
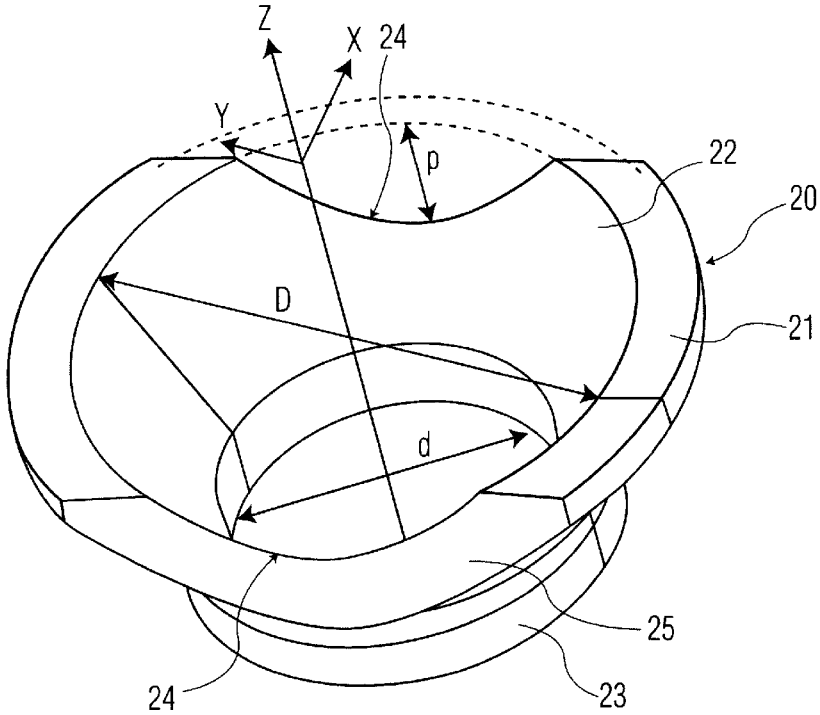
FIG. 4 illustrates a perspective view of a ring according to the invention.

According to a feature of the invention, a ring or core 20 of FIG. 4, for example, of ferromagnetic material, is used for concentrating the electron-beam deflection fields. Core 20 is placed, at least partly, above the deflection coils. Core 20 has a vertical plane of symmetry, YZ, and a horizontal plane of symmetry, XZ. The magnetic reluctance is, in the front region of core 20, in a vicinity of the intersection with the horizontal plane of symmetry, XZ, is greater than in the region of core 20 located in the vicinity of the intersection with the vertical plane of symmetry, YZ. A region located in the vicinity of the intersection with a given plane of symmetry horizontal or vertical, is defined as a region bounded by a radial aperture angle of 45° on either side of the the given plane of symmetry. Core 20 may be used in an arrangement similar to that of FIG. 1, instead of core 10. The front region of core 20 of FIG. 4 is located close to the screen end of CRT 50.

According to the embodiment of the invention, illustrated in FIG. 4, ring or core 20 is made from a body having approximately constant or even thickness "e" and has an approximately frustoconical shape. Core 20 has a front part 21 of internal diameter D, a rear part 23 of internal diameter d and a flared part 22. A pair of cuts, lying symmetrically with respect to the YZ plane, are formed in the front of the ring, at the intersection with the XZ plane, in order to create a pair of semicircular recesses 24.

A cutting planes 25 may be chosen preferably parallel to the Z axis. In this way, the thickness of ring 20 around the intersection of the front part of the ring with the XZ plane varies gradually from the aforementioned value "e" to zero, thereby enabling the value of the reluctance in the region of the recesses 24 to be gradually increased. This gradual change may be preferable, for improving both the convergence and geometrical parameters, to an abrupt change from a thickness equal to "e" to a zero thickness. In contrast to the gradual change, an abrupt change would result from a recess cut-out whose side walls is contained in planes perpendicular to axis Z. Moreover, this gradual change may be altered as required, depending on the desirable extent of correction to be made. In order to accomplish this, the cutting plane may be modified so as to make a non-zero angle with the Z axis.

Tables 1 and 2 below show the measured results obtained from a deflection yoke of the saddle/saddle type for a CRT of the A68SF type having a screen with a diagonal of 68 cm and a radius of curvature greater than 1.5R. The deflection yoke includes ring or core of FIG. 4 made of ferromagnetic material which extends in the direction of the Z axis over a length of 50 mm. Core 20 has a flared part 22 which is 38 mm in length, a rear diameter "d" of 50 mm and a front diameter D of 105 mm.

Table 1 gives the results of measurements of the geometrical and convergence parameters in the following three successive situations:

1. A situation referred to in Table 1 as "the initial situation", in which a prior art ring of FIG. 2 does not have a recess at the front and its thickness "e" is approximately constant;
2. A situation in which the ring or core 20 of FIG. 4, according to the invention, has, at the front, recesses having a maximum depth P equal to 13 mm at the intersection with the horizontal plane XZ; and
3. A situation in which the prior art core of FIG. 3 has, at the front, the same recesses but these lie at the intersection with the vertical plane YZ.

The measured parameters are given as percentage errors. The errors in the North/South geometry, are measured at the extreme horizontal edges of the image (ext. N/S) and half-way between the centre of the image and the extreme edges (int. N/S). The errors in gull-wing distortion are measured at four points in one quadrant of the screen:

on the horizontal external edge of the image:
- at ⅓ from the Y axis, ⅔ from the corner (¼ ext. GW)
- at ⅔ from the Y axis, ⅓ from the corner (⅛ ext. GW); and along the horizontal line lying half-way between the X axis and the upper edge of the image on the screen:
- at ⅓ from the Y axis, ⅔ from the vertical edge (¼ int. GW)
- at ⅔ from the Y axis, ⅓ from the vertical edge of the image (¼ int. GW).

The horizontal convergence errors are measured on the edges of the image at 6 o'clock/12 o'clock (6–12 OC), at 3 o'clock/9 o'clock (3–9 OC), along the direction of the diagonal (corner OC) and along the direction between the diagonal and 6 o'clock/12 o'clock (½H OC).

TABLE 1

| PARAMETERS | INITIAL SITUATION | 13 mm RECESSES ALONG X | 13 mm RECESSES ALONG Y |
|---|---|---|---|
| ext. N/S | −0.75% | −1.21% | −1.89% |
| Int. N/S | −0.75% | −1.08% | −1.18% |
| ¼ ext. GW | −0.05 | −0.04 | −0.01 |
| ⅛ ext. GW | −0.09 | −0.07 | −0.05 |
| ¼ int. GW | −0.10 | −0.09 | −0.08 |
| ⅛ int. GW | −0.13 | −0.12 | −0.10 |
| 6–12 OC | 0.04 | 0.40 | 0.01 |
| 3–9 OC | 0.54 | 0.78 | 0.11 |
| corner OC | −0.49 | 0.36 | −1.19 |
| ½ H OC | 0.04 | 0.51 | −0.45 |

The results of these measurements show that the configuration according to the invention leads to an improved overall situation with respect to the configuration described in European Application EP 701,267.

Although the convergence situation is improved, both in the configuration suggested by the prior art and according to the invention, the results show that the configuration according to the prior art significantly degrades the convergence situation in the corners and between the corners and 6 o'clock/12 o'clock. In particular, the fact of having (6–12 OC), (3–9 OC) and (corner OC), (½ H OC) convergence errors of opposite sign means that it might not be impossible to bring these errors to acceptable values by altering the windings of the deflection coils. In this case it may be necessary to use additional field shapers in order to correct these errors.

On the other hand, in the case of the invention. Table 1 shows an improvement in the geometrical error. Ideally, the geometrical error should be brought close to −1%, corresponding to viewing without any apparent defect at a distance from the screen equal to 5 times the height of the image. Also an improvement in the gull wing is obtained. The convergence situation can be optimized by simple and known alterations of the deflection coils since the measured convergence errors are all of the same sign.

Figure 5:
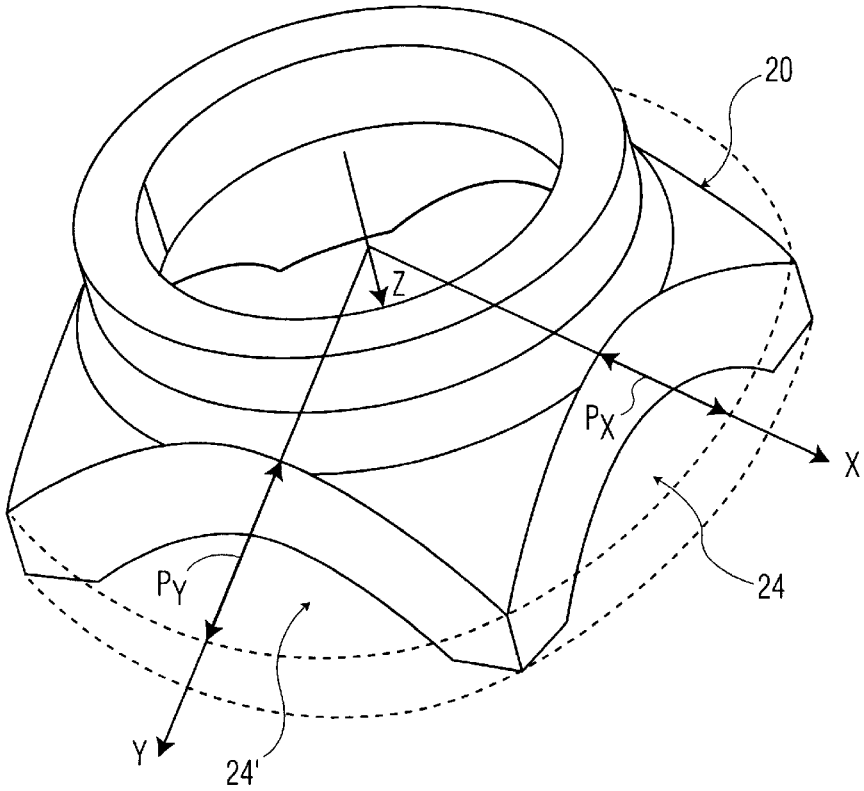
FIG. 5 illustrates a perspective view of a ring according to another embodiment of the invention.

According to another embodiment of the invention, illustrated in FIG. 5, recesses are arranged not only at the intersection of the front of the ring with the XZ plane but also at the intersection with the YZ plane. In this case, the results obtained with regard to the convergence and geometrical parameters are given in Table 2. The initial situation, in which the deflection yoke is equipped with a ring having approximately constant thickness and the front part of which has a uniform reluctance, is compared with the same deflection yoke whose ferromagnetic ring has, in its front part, recesses 24 of depth Px and 24' of depth Py.

It can be seen from the Table 2 that the most favourable configuration is that in which Px is greater than Py. Such favorable configuration which causes the magnetic reluctance of the ring to remain, in its front part lying in a region in the vicinity of the intersection with the horizontal plane of symmetry, greater than in the part lying in the vicinity of the intersection with the vertical plane of symmetry. In this case, all the convergence and geometrical parameters are improved. On the other hand, the case in which Py is greater than Px results in at least one of the four 6–12 OC, 3–9 OC and corner OC, ½ H OC convergence errors being of opposite sign with respect to at least one of the other three. The opposite sign situation, disadvantageously, may not be possible to correct without an additional field shaper.

TABLE 2

| PARAMETERS | INITIAL SITUATION | 13 mm RECESSES ALONG X AND 9 mm RECESSES ALONG Y | 9 mm RECESSES ALONG X AND 13 mm RECESSES ALONG Y |
|---|---|---|---|
| ext. N/S | 0.11 | −2.90 | −1.59 |
| Int. N/S | −0.26 | −1.63 | −1.05 |
| ¼ ext. GW | −0.06 | −0.02 | 0.03 |
| ⅛ ext. GW | −0.10 | −0.04 | 0.01 |
| ¼ int. GW | −0.10 | −0.07 | −0.06 |
| ⅛ int. GW | −0.13 | −0.09 | −0.09 |
| 6–12 OC | 0.08 | 0.37 | 0.82 |
| 3–9 OC | 0.59 | −0.01 | 1.04 |

TABLE 2-continued

| PARAMETERS | INITIAL SITUATION | 13 mm RECESSES ALONG X AND 9 mm RECESSES ALONG Y | 9 mm RECESSES ALONG X AND 13 mm RECESSES ALONG Y |
|---|---|---|---|
| corner OC | −0.82 | −1.77 | 0.06 |
| ½ H OC | −0.21 | −0.96 | 0.34 |

In another embodiment, shown partially by a broken line in FIG. 4, a magnetic reluctance is obtained according to the invention, at the front of the ferromagnetic ring, not by creating recesses, but by locally altering the thickness of the ring by obtaining a thickness e'. Thus, by having a smaller thickness at the intersection of the front part of the ring with the horizontal plane XZ than at the intersection of the front part with the vertical plane YZ, it is possible to obtain the reluctance characteristics according to the invention.

The invention is not limited to deflection devices for colour cathode-ray tubes; its action on the geometry of the image allows the incorporation of a ring of ferromagnetic material according to the invention in a deflection yoke intended to equip a monochrome cathode-ray tube.

What is claimed is:

1. A deflection yoke for a cathode-ray tube, comprising:

a horizontal deflection coil for producing a horizontal deflection field;

a vertical deflection coil for producing a vertical deflection field; and a core made of magnetic material placed in a path of a flux of at least one of said deflection fields in the vicinity of at least one of said deflection coils, said core having a magnetic reluctance, in a front region of said core, that is greater at a horizontal plane of symmetry than at a vertical plane of symmetry.

2. A deflection yoke according to the claim 1, wherein a thickness of the core in said first portion is less than in said second portion.

3. A deflection yoke according to claim 1 wherein a pair of recesses, symmetrical with respect to the vertical plane of symmetry, are formed at said front region of said core at the intersection with the horizon plane of symmetry.

4. A deflection yoke according to claim 1 wherein said core includes a pair of recesses symmetrical with respect to the horizontal plane of symmetry and located, at the front region of said core, at the intersection with the vertical plane of symmetry.

5. Deflection yoke according to claim 4 wherein a plane of cutting of said pair of symmetrical recesses is disposed parallel with one of the vertical plane of symmetry and the horizontal plane of symmetry.

6. Deflection yoke according to claim 1 wherein said core includes a pair of recesses that are semicircular in shape.

* * * * *